United States Patent [19]

Meyrat et al.

[11] Patent Number: 4,842,536

[45] Date of Patent: Jun. 27, 1989

[54] MINIATURE CONNECTOR AND METHOD FOR THE MANUFACTURE THEREOF

[75] Inventors: Pierre-André Meyrat; Alain Oppliger, both of La Chaux-de-Fonds, Switzerland

[73] Assignee: Nivarox-Far S.A., Le Locle, Switzerland

[21] Appl. No.: 152,629

[22] Filed: Feb. 5, 1988

[30] Foreign Application Priority Data

Feb. 9, 1987 [FR] France ..... 87 01671

[51] Int. Cl.[4] ..... H01R 13/64

[52] U.S. Cl. ..... 439/246; 439/695

[58] Field of Search ..... 439/246–252, 439/752, 825–827, 692–697, 891

[56] References Cited

U.S. PATENT DOCUMENTS

| | | | |
|---|---|---|---|
| 1,531,917 | 3/1925 | French | 439/247 |
| 2,517,677 | 8/1950 | Kjell-Berger et al. | 439/825 |
| 2,972,728 | 2/1961 | Cole | 439/246 |
| 2,999,998 | 9/1961 | Cole | 439/252 |
| 3,295,097 | 12/1966 | Van Horssen et al. | 439/246 |
| 3,581,272 | 5/1971 | Yopp et al. | 439/825 |
| 3,864,000 | 2/1975 | Coller et al. | 439/246 |
| 4,066,327 | 1/1978 | Soes | 439/825 |
| 4,437,726 | 3/1984 | Lambert | 439/825 |

FOREIGN PATENT DOCUMENTS

| | | | |
|---|---|---|---|
| 0030141 | 9/1970 | Japan | 439/246 |

*Primary Examiner*—Gary F. Paumen

*Attorney, Agent, or Firm*—Kevin McMahon

[57] ABSTRACT

A connector has a plug and a socket. The plug is provided with at least one male contact member composed of two resilient foils in the shape of spoons. Each of these foils is mounted in a floating manner in the insulating block of the plug. The socket has a female contact member which is rigidly mounted in the insulating block. Thus, when the connector is plugged in, the contact element of the plug can align with the contact element of the socket by which it is then positioned. The connector can be executed with a distance between the contact sets of only 1.27 mm (0.05 inches). The connector is useful with surface mounting technology.

9 Claims, 4 Drawing Sheets

MINIATURE CONNECTOR AND METHOD FOR THE MANUFACTURE THEREOF

BACKGROUND OF THE INVENTION

The present invention relates to a miniature connector, in particular for use with printed circuits, and to a method for the manufacture of such a conductor.

1. Field of the Invention

In particular, the invention relates to the provision of a connector for printed circuits having components termed "surface mounted devices" or "SMD" components produced according to recently-developed assembly methods. According to these methods, electronic components arranged on a printed circuit do not require any connecting wires which have to pass through a circuit board, but are provided with flat contact solder studs. The soldering material is tin paste in round or elliptical granular form and arranged on the board at points where soldering is required. After being positioned at the desired situations on the circuit board, the components are then connected to the printed circuit conductors by heating in a steam bath at temperatures of, for example, 200° C. This procedure causes the tin microbeads to melt, thereby connecting the studs of the component to the printed conductors with which the component is to be connected.

Printed circuits manufactured in this way can accommodate more components per unit surface area than conventional circuits, in particular since smaller components can be employed. Other advantages of SMD technology are improved circuit reliability and shorter operation times.

2. Description of the Prior Art

As far as the Applicant is aware, there is to date no satisfactory connector the construction of which permits use with circuits of the SMD type. The reasons are probably that it is necessary to considerably miniaturize the contacts whilst still bearing in mind the fact that, unlike other SMD components, the connector has to withstand mechanical strain (shocks, vibration) whilst still ensuring reliable electrical contact.

OBJECTS OF THE INVENTION

Generally speaking, one of the difficulties encountered in manufacturing miniature connectors having multiple contacts is that of obtaining good alignment between the male and female contact elements when the two parts of the connector are connected to each other. In fact, the smaller the dimensions and the greater the inevitable imprecisions in manufacture, the greater the risk of disturbing the alignment of the contact elements and of increasing the relative lateral deviation of a female element and a male element. When the distance between two adjacent contacts is only 1.27 mm (0.05 inches) it has been established that conventional measures normally taken to overcome this difficulty are no longer sufficient since even a single insertion of the connector can cause one or more contact elements to break off. Such a break can easily be understood if one bears in mind that the contact elements are very narrow and thin (for example 1 mm and 0.1 mm respectively in practice).

It is an object of the invention to overcome this problem.

BRIEF SUMMARY OF THE INVENTION

According to the invention there is provided a miniature connector having a male plug comprising at least one contact member mounted in a first insulating block, and a female socket having at least one contact member mounted in a second insulating block capable of being assembled to the first block by inserting the contact member mounted in the first insulating block into the socket, characterized in that said socket has, for each contact member of said plug, a receptacle the wall of which is fixed in the block of the socket and formed at least partially by a portion of the contact member of the socket and in that said contact member of the plug has two parallel opposed resilient foils mounted in a floating manner in the block of the plug and partially extending outside this block so as to engage in said receptacle, said resilient foils being immobilized in the connector by gripping of the free end portions in said receptacle by virtue of opposing forces produced by the inherent resilience of the foils.

Due to the fact that the contact member of the plug is only fixed rigidly with respect to the second insulating block after the two parts of the connector have been connected, this contact member is able to accommodate any misalignment of the contact member of the socket in which the female contact member, on the other hand, is always firmly secured.

BRIEF DESCRIPTION OF THE DRAWINGS

The invention will be better understood by study of the following description of one embodiment of the invention.

In the following drawings, which are given solely by way of example.

DETAILED DESCRIPTION OF THE PREFERRED EMBODIMENTS OF THE INVENTION

Figure 1:
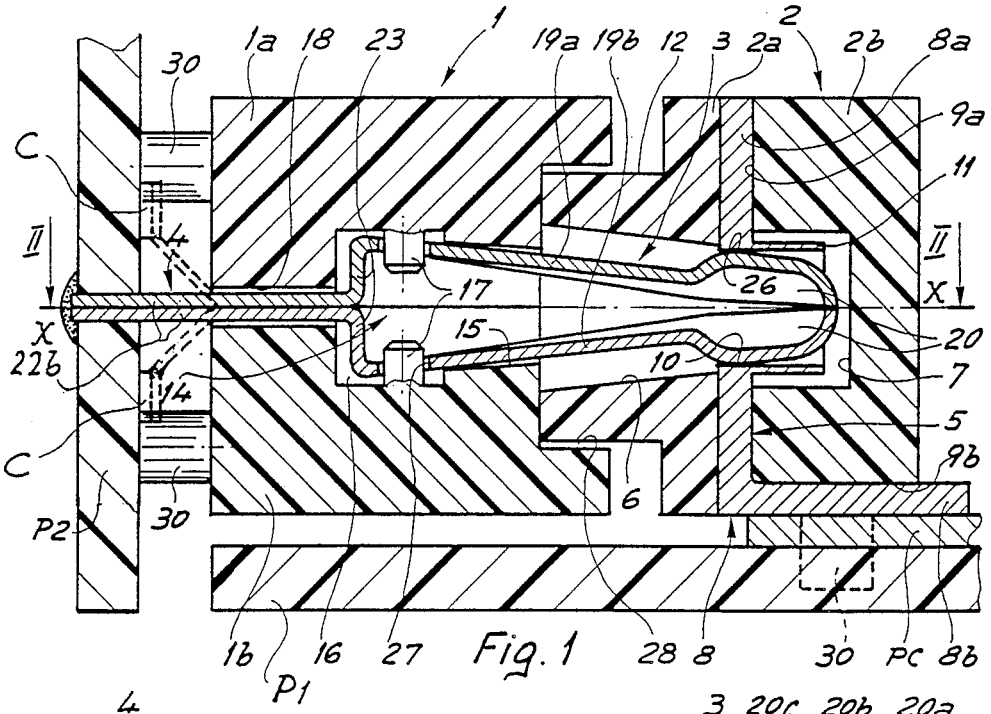
FIG. 1 is a partial sectional view of the miniature connector of the invention.

Reference will first be made to FIGS. 1 to 7 which show the preferred construction of the miniature connector of the invention.

The latter has essentially two parts, the one being a plug 1 and the other a socket 2, and at least one set of contacts 3 composed of a male contact member 4 and a female contact member 5.

When the miniature connector has several sets of contacts 3, these are preferably juxtaposed in such manner as to be capable of being connected at the same time. Referring to FIG. 1, this juxtaposition can be effected in the plane of the paper (embodiment not shown) or perpendicularly to the plane of the drawing (embodiment shown here and visible in FIG. 2).

There will first be described the socket 2 which has two plastic insulating blocks 2*a* and 2*b* assembled, for example, ultrasonically.

The insulating block 2*a* possesses, adjacent to the plug 1, for each set of contacts 3 a truncated conical passage 6 defining an axis X—X and windening in the direction of said plug 1. The block 2*b*, which is disposed away from the plug 1 has a cylindrical cavity 7, coaxial to the truncated conical passage 6. The female contact member 5 is held between the blocks 2*a* and 2*b* during assembly of the socket 2. This contact member 5 is formed by an L-shaped metal strip 8, the longer limb 8*a* of which is pressed between the blocks 2*a* and 2*b* and the shorter limb 8*b* of which extends along the length of the outer surface of the block 2*b*. To lodge the metal strip 8 in the socket 2 the block 2*b* has two grooves 9*a* and 9*b* adapted to receive the limbs 8*a* and 8*b* respectively of the strip 8.

About half way along the limb 8*a* the metal strip 8 has a circular passage 10 which connects, at the face of this limb opposite block 2*a*, to a bushing 11 which is inserted into the material of the strip and which extends into the cylindrical cavity 7.

Figure 2:
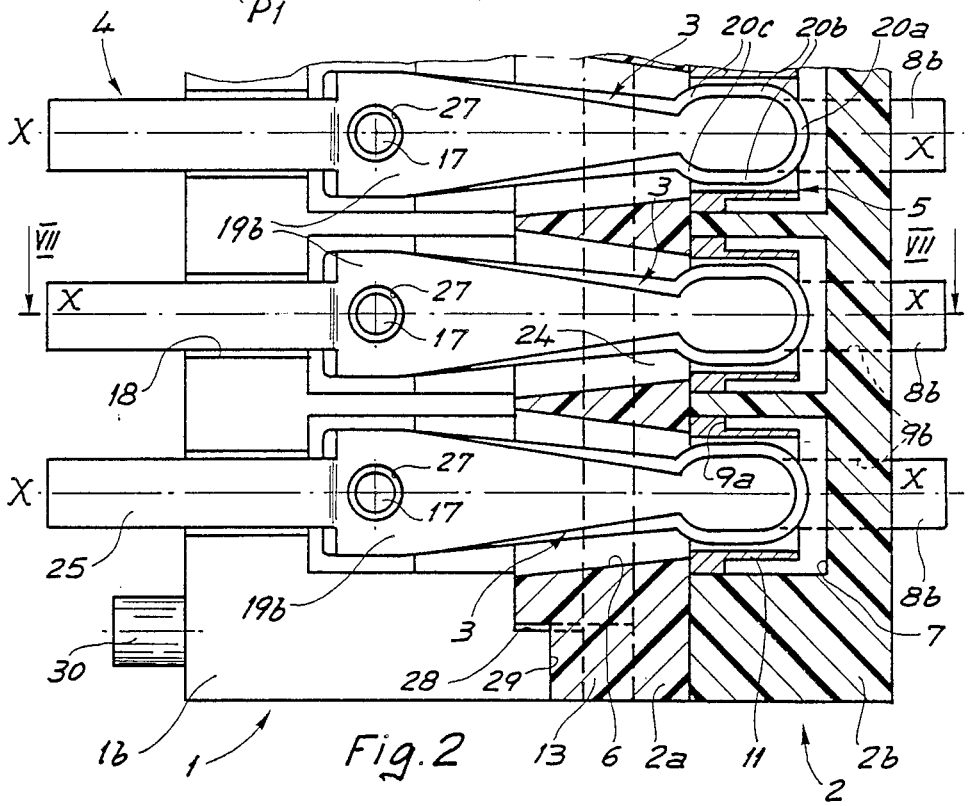
FIG. 2 is a sectional view of this same connector along the line II—II of FIG. 1.

The block 2*a* also has a peripheral rebate 12 interrupted at one of the small faces of this block by a positioning lug 13 (FIG. 2).

The construction of the plug 1 is as follows:

It has two blocks 1*a* and 1*b* made of insulating material and bounded ultrasonically, the plane of the junction between the two blocks being perpendicular to the plane of the junction between the blocks 2*a* and 2*b* of the socket 2. In other words, the plane of the junction of the plus 1 is the X—X axis, whereas that of the socket 2 is perpendicular to said axis.

Considering the plug in its assembled configuration, it has a passage 14 the cross section of which is of variable dimensions along the X—X axis whilst still presenting a rectangular shape along its entire length. Facing the socket 2, the passage has a part 15 which decreases in cross-section towards the outside of the plug, this part extending from a median part 16 which constitutes a cavity between two facing walls from which there extend positioning pins 17. The median part 16 extends from an end section 18 of the passage 14.

The male contact member 4 has two conducting resilient foils 19*a* and 19*b* of identical shape and which extend facing each other throughout the passage 14.

The figures show that each resilient foil has the general shape of a spoon with a bowl 20 and a handle 21 formed in such a way as to present an intermediate strip 22*a* and a rear strip 22*b* linked to one another by a stepped portion 23.

The bowl 20 has an edge the front part 20*a* of which is rounded and constitutes a support area for the resilient foil and the lateral parts 20*b* which are rectilinear. These lateral parts 20*b* are joined by inwardly curved portions 20*c* to raised lateral edges 24 of the intermediate strip 22*a*.

In longitudinal section, that is as shown in FIG. 1, the base of the bowl 20 is inclined forwards in relation to the plane (perpendicular to the plane of the drawing in FIG. 1) containing the surfaces 25 by which the rear strips 22*b* are applied one onto the other. This inclination may be seen both in this configuration (FIG. 1) and in the unplugged configuration of the connector (FIG. 6) although this inclination is more pronounced in the first case than in the second. The reason for this is that in FIG. 6 the foils are free and their bowls are separated from one another.

In contrast, in the plugged in configuration of the connector, these bowls are brought close to one another to present a portion of the electrical contact surface 26 to the female contact member. There will now be explained the behaviour of the resilient foils 19*a* and 19*b* during plugging-in and unplugging of the connector.

The portion of the contact surface 26 defined on the outer face of each bowl is situated more or less at the site where this latter begins to narrow towards the back in joining onto the intermediate strip 22*a*.

Figure 4:
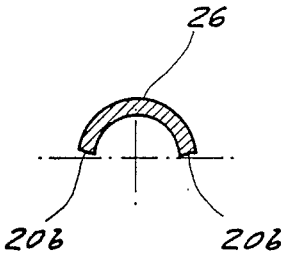
FIGS. 4 and 5 are sectional views along the lines IV—IV and V—V respectively of FIG. 3.
Figure 5:
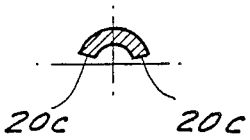

FIG. 4 shows the profile of the bowl at this point whereas FIG. 5 shows the profile of the foil at the exact point at which the bowl joins the intermediate strip.

It should be noted that the extent of the contact surface 26 is not very well defined since, in view of the extremely low dimensions and thickness of each foil, the deformation which it undergoes during plugging-in can differ from one foil to the other. Nevertheless, the shape of the male contact member which has just been described has proved to be very effective with regard to the quality of the electrical contact obtained.

A retaining hole 27 is provided in the intermediate strip 22*a* close to the stepped portion 23. It can be seen from FIG. 1 that the diameter of this hole 27 is larger than the diameter of the cross section of the positioning pins 17.

It can also be seen from FIG. 1 that the height of the section of the end part 18 of the passage 14 is greater than the total thickness of the two rear superimposed strips 22*b* of the two foils 19*a* and 19*b* when these are in place in the plug 1. Similarly, the width of the rear strip 22*b* of each foil 19*a* or 19*b* is less, not only than the rest of this foil, but also than the width of the section of the end part 18 of the passage 14.

Figure 6:
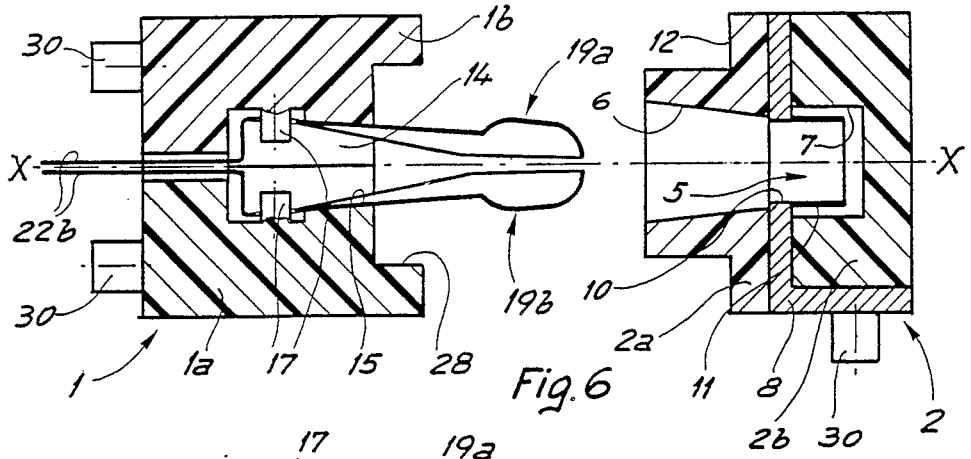
FIG. 6 is a sectional view of the connector of the invention in its non-assembled configuration, the scale being reduced as compared to that of FIG. 1.

As a result, when the connector is unplugged, as shown in FIG. 6, the foils 19*a* and 19*b* are entirely floating in the plug 1 and they are simply retained by the positioning pins 17 which extend through the holes 27.

It can also be seen from FIG. 2 that the width of each bowl 20 at the level of the lateral edge portions 20*b* is smaller than the diameter of the hole 10 and the bush 11 of the female contact member.

In the unplugged configuration (FIG. 6) the foils 19*a* and 19*b* are floating and have a certain freedom of movement. Nevertheless, the foils are so formed that the bowls are resiliently separated from one another, the intermediate strips 22*a* resting against the oblique walls of the narrowing part 15 of the passage 14.

When the plug 1 is inserted into the socket 2 the bowls 20 of the pairs of foils 19*a* and 19*b* are first brought close to one another along the profile of the respective truncated conical passages 6 of the socket 2. During this movement, the front portions 20*a* of the bowls of each pair come to bear against each other whilst the intermediate strips 22*a* move away from the oblique walls of the narrowing part 15 of the passage 14. This operation already implies a resilient deformation of the foils, the rear strips 22*b* of which are increasingly firmly pressed against each other. Moreover, in view of the freedom of movement of each foil, particularly in the lateral direction, it is able to adapt its position to the fixed position of the corresponding female contact member.

Continuing the movement of insertion, the foils 19*a* and 19*b* are then slightly deformed in the junction zone between the bowl 20 and the handle 21, the reaction to this resilient deformation being produced at the front edges 20*a* of the bowls 20 and by the application onto one another of the rear strips 22*b*.

Figure 3:
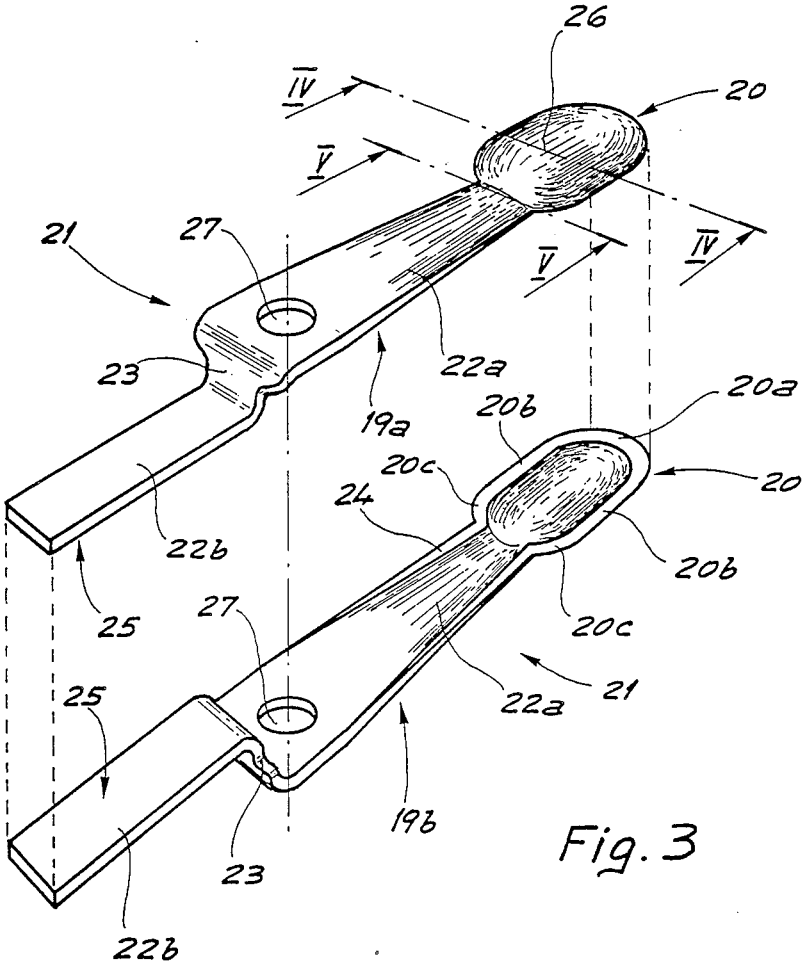
FIG. 3 shows, in a perspective view, two resilient paried foils used for the contact member of the connector plug.
Figure 7:
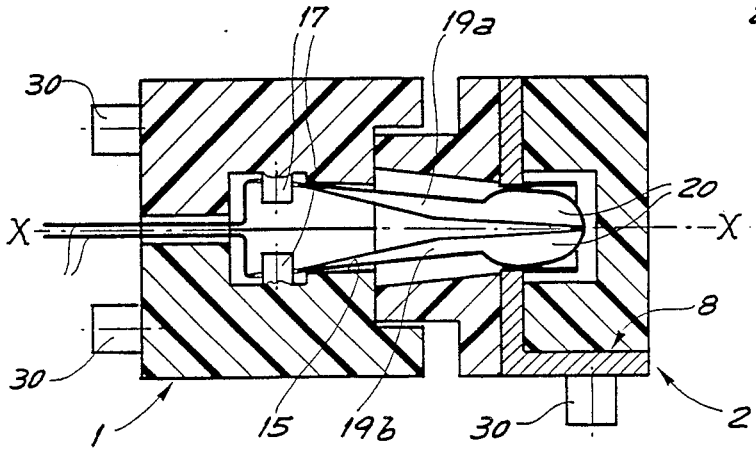
FIG. 7 is a sectional view on the same scale as that of FIG. 6 of the assembled connector.

When the connector finally reaches the plugged in configuration shown in FIGS. 1, 2 and 7, the resilient deformation of the foils 19*a* and 19*b* is such that they are rigid with the female contact member by virtue of the pressure exerted thereon by the contact zones 26 (FIGS. 3 and 4). There results an electrical contact having an extremely low contact resistance. Moreover, all the relative positioning tolerances of the contact members are entirely absorbed.

The arrangement according to the invention also ensures a dissociation of the functions of resilient contact on the one hand and shock absorption on the other, the first function being established by the bowls 20 in cooperation with the female contact member and the second by the intermediate portions 22*a* of the foils 19*a* and 19*b*.

The plug 1 presents on its face directed towards the socket 2 a cavity 28 into which it is possible to position the part of this socket surrounded by the passage 6. The edge of the plug which bounds the cavity 28 is interrupted at 29 (FIG. 2), that is at one of the small faces of the block of said plug, to receive the positioning lug 13 provided on the socket. Thus, errors in plugging-in the connector are not possible.

It will be noted that the connector that has just been described is particularly suitable for use in the technology of Surface Mounted Devices. By way of example, FIG. 1 shows a board P1 of a printed circuit on which is mounted the socket 2 by means of a connection path PC on which the small limb 8*b* of the metal foil 8 has just been soldered. As already indicated above, to permit the soldering, the socket 2 is equipped with a certain amount of a paste composed of tin microbeads. The board P1 having been equipped with all its components it is submitted to a steam bath at 200° C. causing the tin to melt between the contact foil 8 and the conducting path PC.

FIG. 1 illustrates that the connection to a printed circuit may also be effected by means of conventional soldering, as is shown here by way of example with regard to the plug 3. This latter is connected to a printed circuit board P2 traversed by the rear strips 22*b* of the foils 19*a* and 19*b* of each contact set 3. It should be noted that this manner of connecting the plug 1 to a printed circuit board somewhat restricts the freedom of the foils 19*a* and 19*b* in this plug.

However, the solder being effected at the extremity of the rear strips 22*b*, this connection does not prevent the mutual positioning of the contact members at the moment of plugging-in the connector, as has just been described.

The plug 1 may, of course, also be linked to the circuit board P2 by means of SMD technology. For this purpose it is sufficient to fold back the free portions of the rear parts 22*b* against the board P2, the corresponding contacts C of which are previously provided with soldering paste. This way of mounting the plug is illustrated by dotted lines in FIG. 1.

To fix the positioning of the connector in relation to the boards P1 and P2, positioning or distance pins 30 can be moulded directly with the plug 1 and the socket 2.

The material chosen for the contact elements of this connector is preferably an alloy notably comprising nickel, copper, zinc together with the addition of various other materials.

A particularly suitable material is Arcap which is a composition containing 25% nickel, 56% copper, 17% zinc and 2% of various additional metals. The contact elements are preferably gold plated to improve their conductivity. The material indicated has the advantage of being strictly nonmagnetic, of presenting very good resistance to corrosion and of having a high modulus of resilience.

It has already been indicated above that considerable difficulties arise when one wishes to manufacture a miniature connector having a distance between the contact sets that is as small as 1.27 mm (0.05 inches). It would of course be possible to cut and shape each of the contact elements separately, but such a method would involve considerable labour and the connector would consequently have a prohibitively high prime cost.

It is, moreover, known in connector manufacturing technology for the contact elements to be cut in a sheet of conducting metal in such a way that they all extend side by side and laterally from a longitudinal zone of the sheet which is not separated from the contact elements until after their mounting in the fixing blocks of the connector.

However, this method cannot be adapted directly to contacts as small as those of the connectors of the present invention since there would be too little material between the portions of the material of the sheet needed to produce two adjacent contact foils of the plug to effect the required cutting and shaping of the metal.

The invention consequently proposes the provision of a method which makes it possible to overcome this manufacturing difficulty. The principle of this method is shown in FIGS. 8 to 12.

Figure 9:
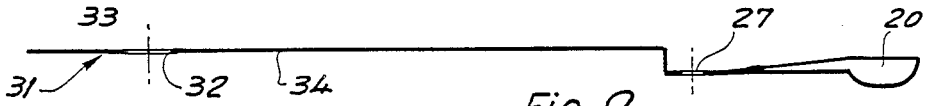
FIG. 9 is a sectional view along the line IX—IX of FIG. 8.
Figure 8:
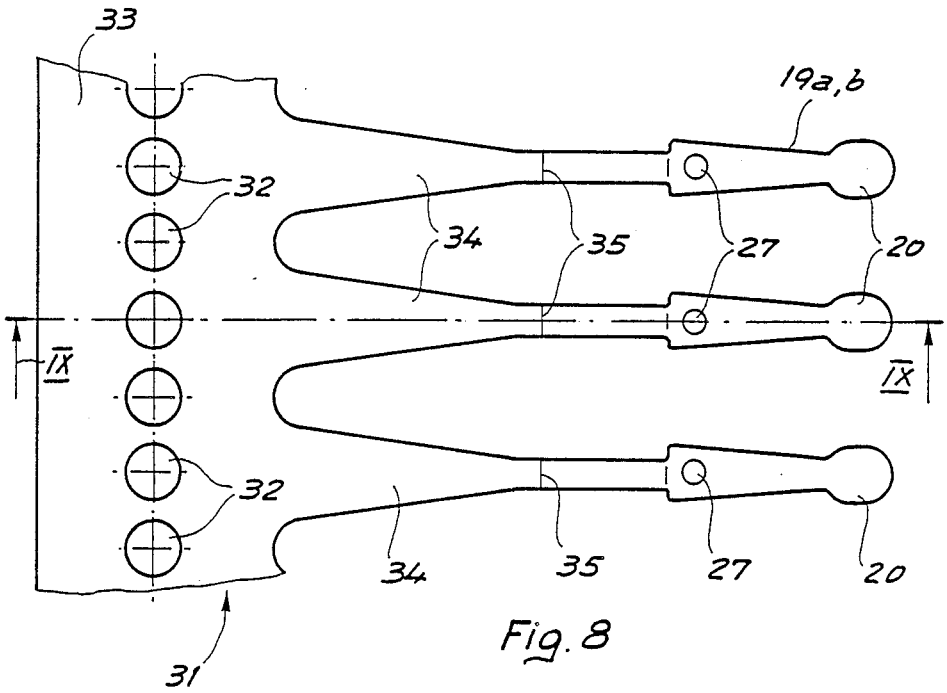
FIG. 8 shows a portion of metal sheet, cut and shaped, said sheet being intended for use in the method of manufacturing the connector of the invention.

FIGS. 8 and 9 show a sheet 31 of conducting metal already machined to form therein on the one hand positioning holes 32 and on the other hand foils 19*a*, 19*b* juxtaposed and joined to the mutual longitudinal zone 33 of the sheet by tongues 34. The distance between the foils is twice that which should be maintained between the contact sets 3 on the connector. In the example described herein, the distance being 1.27 mm (0.05 inches), the centres of the holes 32 are separated from each other by this distance. The foils 19*a*, 19*b* are held linked to the tongues 34 by rupture zones 35. The distance between the foils is sufficient to permit their cutting out without problems in the material of the sheet, i.e. twice the distance of 1.27 mm (0.05 inches).

Figure 11:
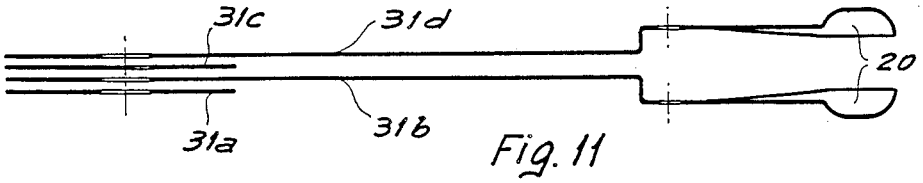
FIGS. 11 and 12 are sectional views taken along the lines XI—XI and XII—XII respectively of FIG. 10.
Figure 12:
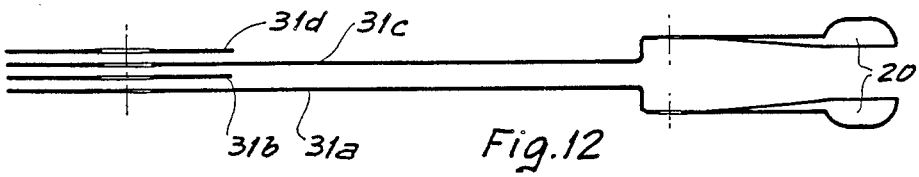
Figure 10:
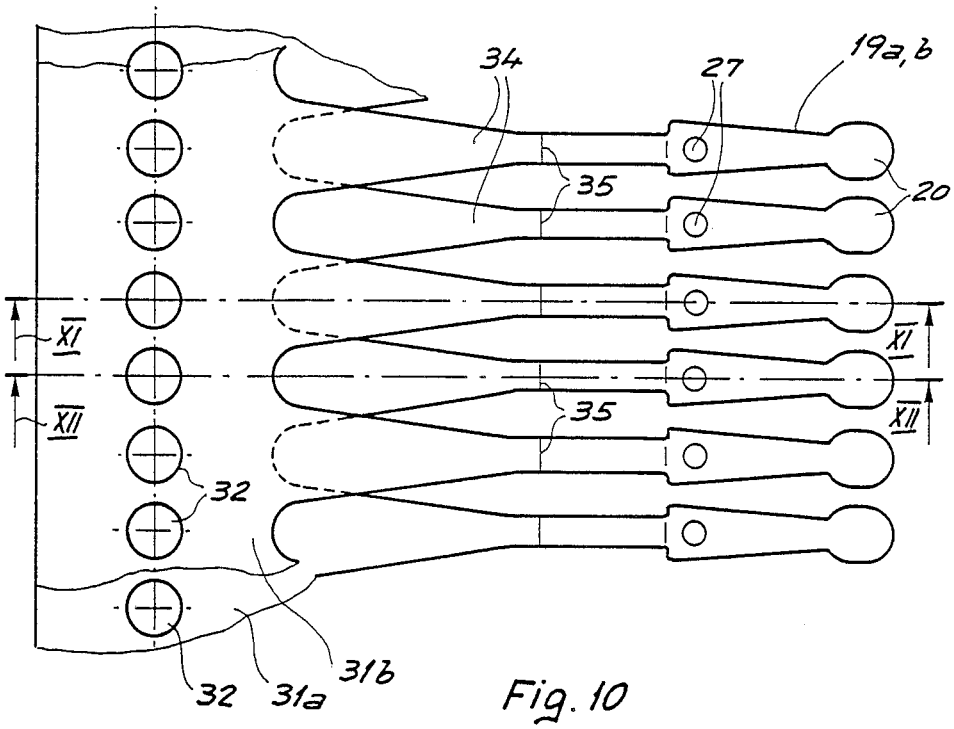
FIG. 10 shows the superposition of four sheets of the type shown in FIG. 8, this arrangement making it possible to obtain a standardized separation of 1.27 mm (0.05 inches) between the contacts of the connector.

If, according to the method of the invention, four sheets prepared in this manner are superimposed as shown in FIGS. 10 to 12, one obtains an assembly of opposing foils 19*a*, 19*b* necessary for the production of a connector having a distance half of that of the foils of the sheet shown in FIG. 8, i.e. having the distance that it is wished to obtain.

More precisely, the sheets are superimposed in pairs (sheets 31*a* and 31*b*) but in such a way that their foils are staggered by one step between the locating holes 32 and that the concavity of their bowls 20 is turned in the same direction. There is then prepared the same assembly starting with the sheets 31*c* and 31*d* and this assembly is superimposed the other way round on the first assembly. Under these conditions the set obtained has four sheets with pairs of juxtaposed opposing foils having a distance of 1.27 mm (0.05 inches).

A set of this type cut in length to provide the desired number of contact members is then placed in a mould designed for the manufacture of insulating blocks 1*a* and 1*b*. After moulding it then suffices to break the connections in the rupture zones 35 to release the plug from the remainders of the sheets 31*a* to 31*d*.

The female contact elements may be executed in the same manner using, of course, in each case only two strips in which the foils 8 will have been cut and shaped.

It is clear that it is possible to imagine numerous modifications of the invention. For example, one could choose a different shape for the male contact members by giving them a constant longitudinal section over their entire extent conforming to FIG. 1. In these circumstances it is clear that the female contact element, instead of having a cylindrical passage, could be executed in the form of one or several flat plates. It is nevertheless essential that, regardless of the modification chosen, the male contact members always remain mounted in floating manner in the plug 1 in order to be able to adapt themselves during plugging-in of the connector to different dimensions due to manufacturing tolerances of the sockets.

We claim:

1. A miniature connector assembly having a male plug and a female socket mating with said male plug, (a) said male plug including a first insulating block having at least one first contact member floatingly mounted therein;

(b) said female socket including a second insulating block having at least one second contact member fixedly mounted therein;

(c) said first contact member including a pair of opposed, non-unitary, resilient foils which are independently floatingly mounted, having an extending free end portion for insertion into said socket;

(d) said second contact member including a receptacle positioned for receiving said first contact member, said receptacle including a wall fixed in said second insulating block;

(e) whereby said first and second insulating blocks align and mate with each other in assembly; and (f) said second insulation block and said receptacle including means for gripping and immobilizing the free end portions of said opposing resilient foils and making electrical contact therewith by virtue of the opposing forces caused by the inherent resilience of said resilient foils.

2. A miniature connector assembly according to claim 1, wherein said wall of said receptacle defines a contact portion having a cross section of closed curvature within said second contact member of said socket.

3. A miniature connector assembly according to claim 2, wherein said cross section of closed curvature is circular.

4. A miniature connector assembly according to claim 1, wherein each of said resilient foils includes a first terminal pressure surface proximate said free end portion thereof for engagement with the other foil, a second terminal pressure surface proximate the opposite end thereof, and, intermediate said first and second terminal pressure surfaces, a contact surface for establishing electrical contact with said wall of said receptacle; pressure between said first terminal pressure areas of said resilient foils being caused by the pressure exerted on said foils by the gripping action of said receptacle on the contact surfaces of each said foil, said pressure being produced by virtue of the resilience of said foils.

5. A miniature connector assembly according to claim 4, wherein each of said resilient foils is generally spoon-like in shape, the outer curvature of the bowl of said spoon constituting the electrical contact surface and the front edge of said spoon defining said first thermal pressure surface and the handle of said spoon defining said second terminal pressure surface.

6. A miniature connector assembly according to claim 1, wherein said first insulating block includes a passage, and a pair of lugs projecting from the walls thereof, said foils extending through said passageway and having apertures engaged with said lugs, the dimensions of the lugs and of said apertures being such that there is a floating clearance between said lugs and said apertures.

7. A miniature connector assembly according to claim 6, wherein the width of the passage is greater than the width of the foil over the entire length of the passage.

8. A miniature connector assembly according to claim 1, wherein the foils are made of an alloy containing 25% nickel, 56% copper and 17% zinc.

9. A multiple miniature connector assembly having a male plug and a female socket respectively including first and second insulating blocks having respective pluralities of male and female contact members mounted therein, each of said male contact members comprising a pair of opposed, non-unitary, resilient foils which are independently, floatingly mounted in said first insulating block, said female contact members being rigidly mounted in said second insulating block, said male contact members being firmly immobilized in said connector assembly upon mating.

* * * * *